US005332225A

United States Patent [19]

Ura

[11] Patent Number: 5,332,225

[45] Date of Patent: Jul. 26, 1994

[54] EQUIPMENT FOR BALL HITTING PRACTICE

[76] Inventor: Mitsuo Ura, 8-10, Koyahata 3-chome, Odawara-shi, Kanagawa-ken, Japan

[21] Appl. No.: 3,542

[22] Filed: Jan. 13, 1993

[30] Foreign Application Priority Data

Apr. 22, 1992 [JP] Japan ..... 4-127969
Jul. 20, 1992 [JP] Japan ..... 4-214499

[51] Int. Cl.[5] ..... A63B 69/36

[52] U.S. Cl. ..... 273/186.2; 273/194 R; 273/187.4

[58] Field of Search ..... 273/187.4, 186.2, 186.1, 273/187.2, 35 R, 193 R, 194 B, 77 R; 340/686

[56] References Cited

U.S. PATENT DOCUMENTS 3,717,857 2/1973 Evans ..... 273/187.2
3,945,646 3/1976 Hammond ..... 273/186.2
4,582,325 4/1986 Yuhara ..... 273/186.2
4,991,850 2/1991 Wilhlem ..... 273/187.4
5,082,283 1/1992 Conley ..... 273/186.2
5,150,104 9/1992 Thomas et al. ..... 340/686
5,209,483 5/1993 Gedney et al. ..... 273/187.4

*Primary Examiner*—Mark S. Graham
*Attorney, Agent, or Firm*—Steinberg, Raskin & Davidson

[57] ABSTRACT

An equipment for ball hitting practice capable of carrying out an analog or digital display of a defect in a ball hitting form to permit a practicer correct the defective form without deteriorating an appearance of a ball hitting stick such as a golf club and its balance. A small-sized gyro is arranged in a shaft of a golf club to detect rotation of the shaft about an axis thereof, to thereby generate a signal. The signal is then fed to a receiver box by wire or wireless transmission and displayed as unintentional movement of a ball hitting face of the club.

1 Claim, 5 Drawing Sheets

EQUIPMENT FOR BALL HITTING PRACTICE

BACKGROUND OF THE INVENTION

This invention relates to an equipment for ball hitting practice which is suitable for use for swing or stroke practice for ball hitting games or sports such as golf, gate ball and the like, and more particularly to an equipment for ball hitting practice of the face angle display type which is particularly suitable for putter stroke practice.

Conventionally, for the purpose of swing or stroke practice of a ball hitting stick and more specifically a golf club such as a putter, a driver or the like, an electronic type golf training apparatus has been proposed and put to practical use. The apparatus is generally constructed so as to detect and display a swing orbit of the ball hitting stick and/or an angle of a ball hitting face of a head of the ball hitting stick in the moment of impacting or hitting of the face against a ball, so that a practicer may be weaned from a bad habit in swing or stroke of the stick and/or a defect in a ball hitting form, resulting in learning a well-balanced form.

Such a conventional golf training apparatus is generally classified into two types. One or first type is so constructed that a photosensor or the like is embedded in or vertically arranged on the head of the ball hitting stick or golf club in a manner to be in proximity to an expected swing orbit of the head of the stick club to detect a speed of the ball hitting face and/or its angle ( face angle) before and after impacting or hitting of the club head against a golf ball to generate an electrical signal, which is then visually displayed in the form of either an analog display or a digital display.

The other or second type is adapted to arrange a sensor on the side of the ball hitting stick or golf club. More particularly, a pressure-sensitive sensor is embedded in a sweet spot section of the ball hitting face of the club head, to thereby detect a magnitude of impacting of the face against a golf ball and/or its direction to generate an electrical signal, which is then fed to a display device installed at a remote place by wire or wireless transmission, resulting in obtaining a visual display.

Unfortunately, the first type golf training apparatus, as noted from the foregoing, is adapted to detect movement of the golf club from the outside of the club, so that it is difficult to accurately detect the face angle. Also, the apparatus causes a position for the detection to be restricted to a point at which the club head is impacted or hit against a golf ball and its vicinity, therefore, it is impossible to determine movement of the club head through whole stroke or swing including address to the ball, backswing, arrival in a top of the stroke, downswing, impacting of the club head against the ball and follow-through. Further, the first type apparatus requires to arrange a plurality of sensors such as photosensors, magnetic sensors and the like at predetermined intervals in proximity to a tee and a cup and along an estimated swing line of the club head. Also, the sensors, as well as the tee and cup are required to be arranged on a mat for practice or a floor for practice. Thus, the first type golf training apparatus is large-sized and complicated in structure, so that movement and transportation of the apparatus is highly troublesome.

The second type golf training apparatus permits the detection to be carried out with increased accuracy as compared with the first one. However, what is detected by the second type apparatus is only data instantaneously obtained at the time of impacting or hitting of the ball hitting face of the club head against a golf ball. Thus, the apparatus fails to detect movement of the golf club during the swing or stroke, to thereby fail to provide a practicer with, for example, data on unintentional movement of the face of the club head due to rotation of a shaft of the golf club about an axis thereof. Also, the second type apparatus fails to properly generate a signal unless the golf ball is accurately hit on a sensor positioned at a center of the ball hitting face. Therefore, the apparatus is unsuitable for a beginner unfamiliar with swing of a golf club, so that the applicability is substantially restricted.

SUMMARY OF THE INVENTION

The present invention has been made in view of the foregoing disadvantage of the prior art.

Accordingly, it is an object of the present invention to provide an equipment for ball hitting practice which is capable of detecting rotational movement of a shaft of a ball hitting stick such as a golf club or the like about an axis thereof to display a variation in angle of a ball hitting face of the stick.

It is another object of the present invention to provide an equipment for ball hitting practice which is capable of detecting and displaying even a very fine variation in rotation of a ball hitting face of a head of a ball hitting stick.

It is a further object of the present invention to provide an equipment for ball hitting practice which does not adversely affect an appearance of a ball hitting stick such as a golf club or the like and its swing balance.

It is still another object of the present invention to provide an equipment for ball hitting practice which is capable of being constructed in a compact or simple manner sufficiently to facilitate the transportation and permit the equipment to be portable.

In accordance with the present invention, an equipment for ball hitting practice is provided. The equipment includes a gyro mechanism mounted at a ball hitting stick and adapted to generate a signal; an amplification circuit means for amplifying the signal generated by the gyro mechanism; a display means for outputting the signal as an angle of unintentional movement of a ball hitting face of the ball hitting stick; and a power circuit means, In a preferred embodiment of the present invention, the equipment is separated into a transmission side and a receiving side, The transmission side may be arranged at the ball hitting stick and the receiving side is provided in a receiver box arranged separate from the ball hitting stick.

In a preferred embodiment of the present invention, the gyro mechanism is provided on the transmission side and the display means is arranged on the receiving side.

In a preferred embodiment of the present invention, the amplification circuit means includes a first amplification circuit arranged on the transmission side and a second amplification circuit arranged on the receiving side. The power circuit means includes a first power circuit arranged on the transmission side and a second power circuit arranged on the receiving side. The display means comprises an angle display hitter.

In a preferred embodiment of the present invention, the equipment further comprises a wireless transmission circuit arranged on the transmission side and a wireless receiving circuit arranged on the receiving side.

In a preferred embodiment of the present invention, the ball hitting stick includes a hollow shaft having a cartridge detachably mounted therein. The gyro mechanism, first amplification circuit, wireless transmission circuit and first power circuit are housed in the cartridge. The wireless receiving circuit, second amplification circuit, angle display meter and second power circuit are housed in the receiver box.

In a preferred embodiment of the present invention, the ball hitting shaft includes a shaft. The equipment further includes a circuit to which an impact signal generated by the gyro mechanism upon hitting of a ball hitting face of the ball hitting stick against a ball is fed in the form of a trigger signal and which holds an output level of the display means while having a peak signal of an angular velocity of rotation of the shaft in the moment of the hitting input thereto.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, an equipment for ball hitting practice according to the present invention will be described hereinafter with reference to the accompanying drawings.

Figure 1A:
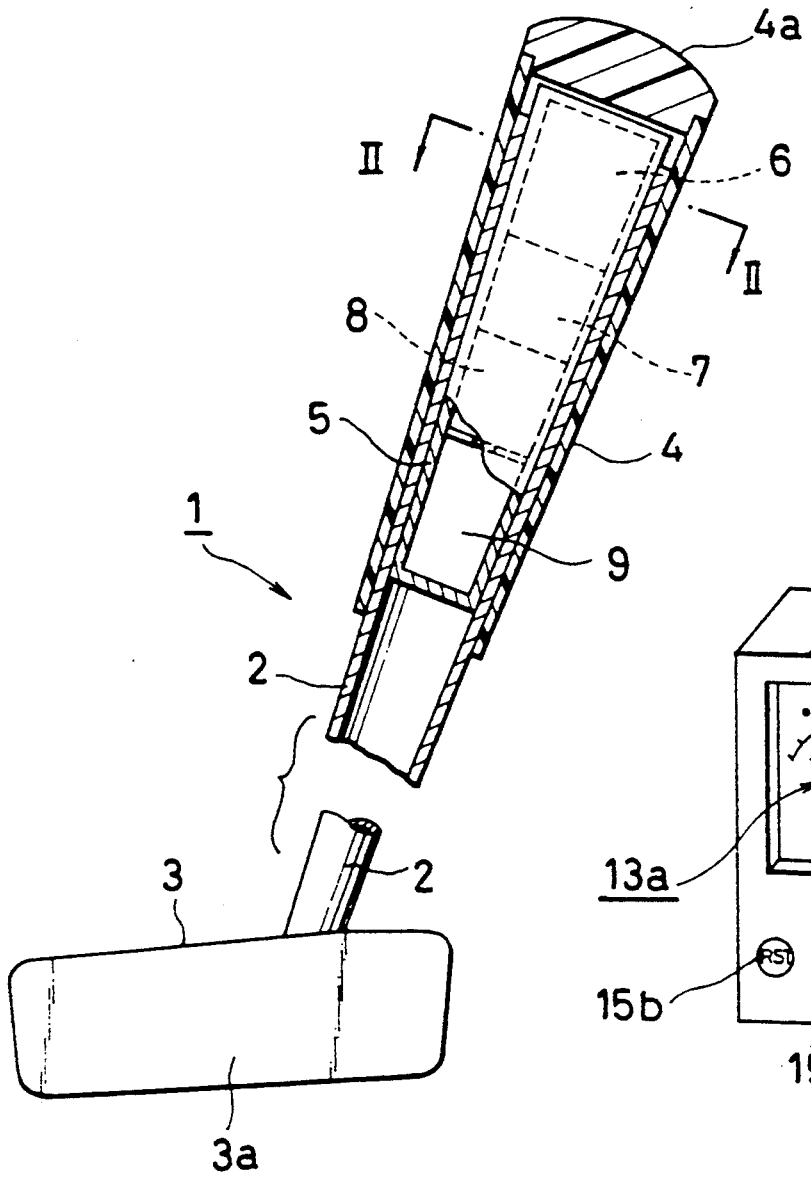
FIG. 1A is a fragmentary perspective view partly in section showing a ball hitting stock in the form of a golf putter in which a substantial part of an embodiment of an equipment for ball hitting practice according to the present invention is incorporated.
Figure 1B:
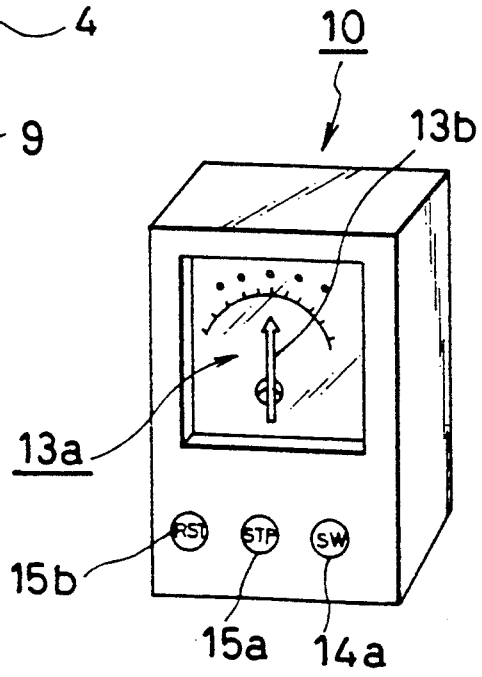
FIG. 1B is a perspective view showing a receiver box.

Referring first to FIGS. 1A and 1B, an embodiment of an equipment for ball hitting practice according the present invention is illustrated. An equipment of the illustrated embodiment is generally constructed that a transmission side thereof is incorporated in a ball hitting stick generally designated by reference numeral 1 and a receiving side thereof is arranged separate from the transmission side. In the illustrated embodiment, the ball hitting stick 1 is in the form of a golf putter. The ball hitting stick 1 includes an elongated hollow cylindrical shaft 2 made of a steel material, which is fixedly mounted at a distal end thereof with a head 3 and at a proximal end thereof with a rubber grip 4 and a grip end 4*a*. The head 3 has a ball hit ting face 3*a* defined on a surface thereof. The shaft 2 of the stick 1 is provided in the distal end thereof with a storing cartridge 5, which is made of a suitable material such as plastic or the like and formed into a substantially cylindrical and hollow shape. Also, the cartridge 5 is formed into dimensions sufficient to permit it to be detachably fitted in the distal end of the shaft 2. In the cartridge 5 are housed a gyro mechanism 6, an amplification circuit 7, a wireless transmission circuit 8 and a drive power circuit 9.

Figure 4:
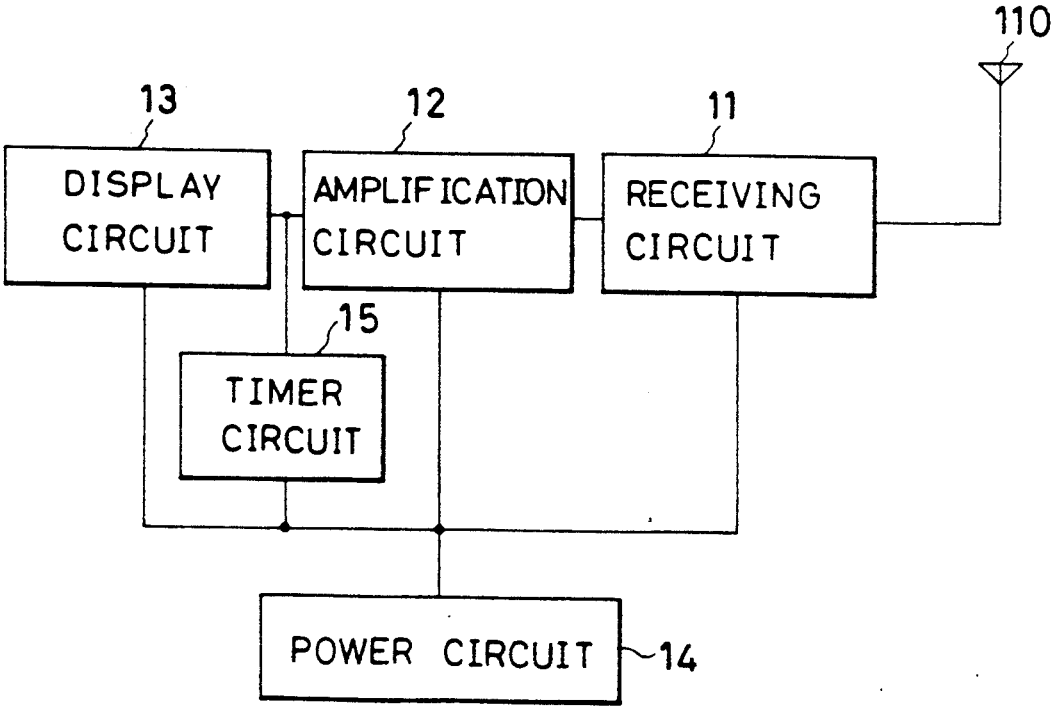
FIG. 4 is a block diagram showing an electric circuit on the side of a receiver box.

The equipment of the illustrated embodiment also includes a receiver box 10, which is adapted to be arranged separate from the ball hitting stick 1 and portable. In the receiver box 10, as shown in FIGS. 1B and 4, are housed a wireless receiving circuit 11, an amplification circuit 12, a display circuit 13 equipped with an angle display meter 13*a*, and a drive power circuit 14. Also, a timer circuit 15 may be provided for controlling an operation timing of the angle display meter 13*a*. On an outside of the receiver box 10 are arranged a power switch 14*a* for the power circuit 14, a setting stop switch 15*a* for temporarily stopping a pointer 13*b* of the angle display meter 13*a* at a predetermined timing, and a reset switch 15*b* for releasing an operation of the stop switch 15*a*, as shown in FIG. 1B.

Figure 2:
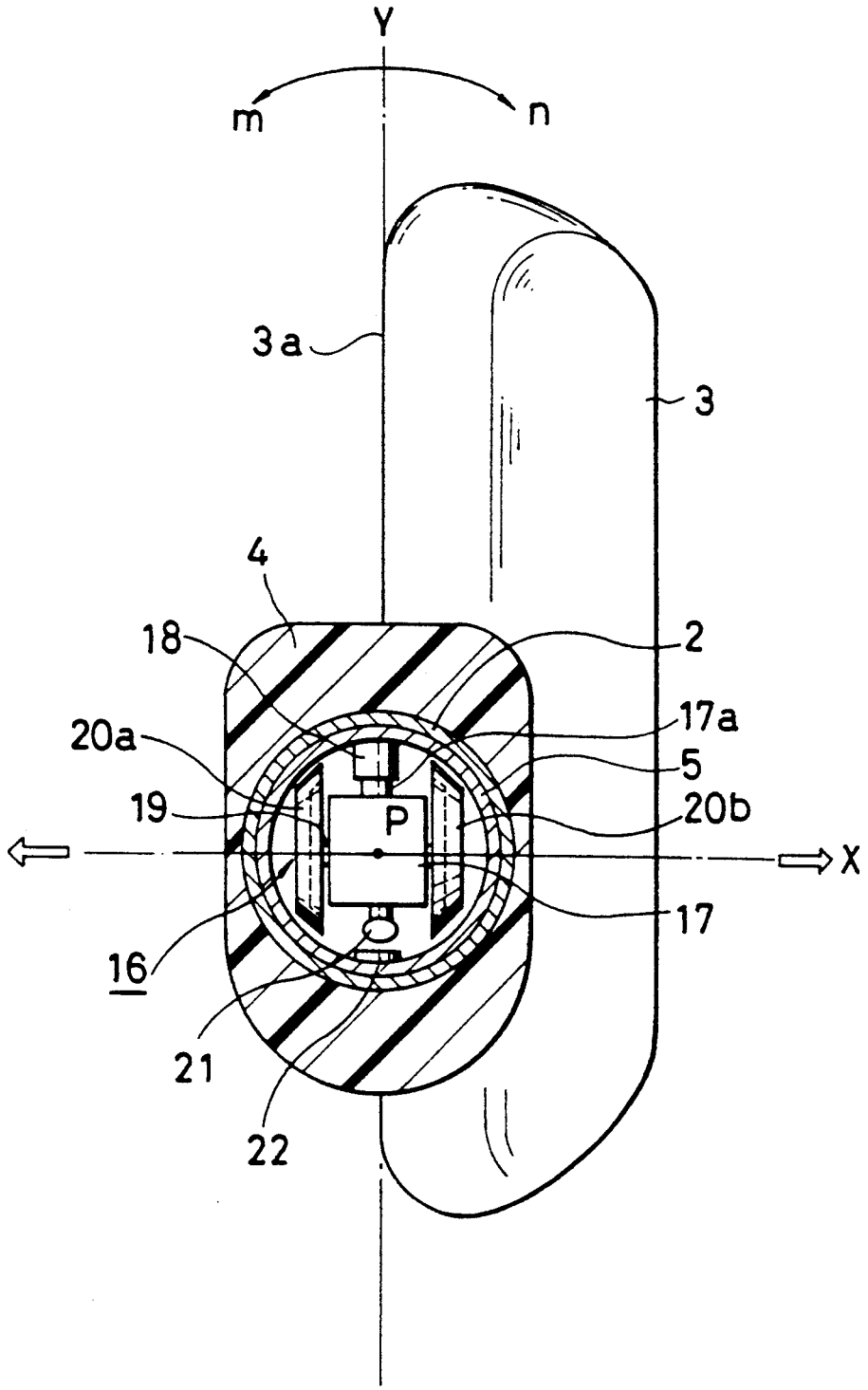
FIG. 2 is a sectional view taken along line II—II of FIG. 1A.

The gyro mechanism 6, as shown in FIG. 2, includes a down-sized or small-sized gyro 16, a motor 17 serving as a drive source, a casing for the motor 17 including a casing base 17*a*, which is rotatably supported by a bearing 18 fixedly mounted on an inner surface of the cartridge 5. The motor 17 includes an output shaft 19, which is securely mounted at both ends thereof with flywheels 20*a* and 20*b*.

An axis Y of pivotal movement of the motor 17 which extends through the casing base 17*a* is tie fined so as to be substantially perpendicular to an axis X of the output shaft 19 of the motor 17. The cartridge 5 is preferably arranged in the shaft 2 in a manner to permit an intersection between the axis X and the axis Y to be substantially defined or positioned on an axis P of the shaft 2. Such arrangement of the cartridge 5 permits the gyro 16 to carry out detection with high accuracy. However, in order to permit the gyro 16 to carry out detection, it is merely required to arrange the gyro on any one of an outside of the ball hitting body and its inside.

The motor casing is provided on a side thereof opposite to the casing base 17*a* with a permanent magnet 21, which is positioned on the axis X of rotation of the output shaft 19 of the motor 17 and projected therefrom. The cartridge 5 is securely mounted on an inner surface thereof with a magnetoelectric transducer 22 in a manner to face the permanent magnet 21. For the transducer 22 may be used a suitable element such as a magneto-resistive element, a hall element or the like.

Thus, it will be noted that the gyro mechanism 6, in the illustrated embodiment, is constituted by the down-sized gyro 16, motor 17, casing base 17*a*, bearing 18, motor output shaft 19, flywheels 20*a* and 20*b*, permanent magnet 21, magnetoelectric transducer 22, and an output circuit (not shown) of the transducer 22.

Now, the manner of operation of the equipment of the illustrated embodiment constructed as described above will be described hereinafter.

Figure 5:
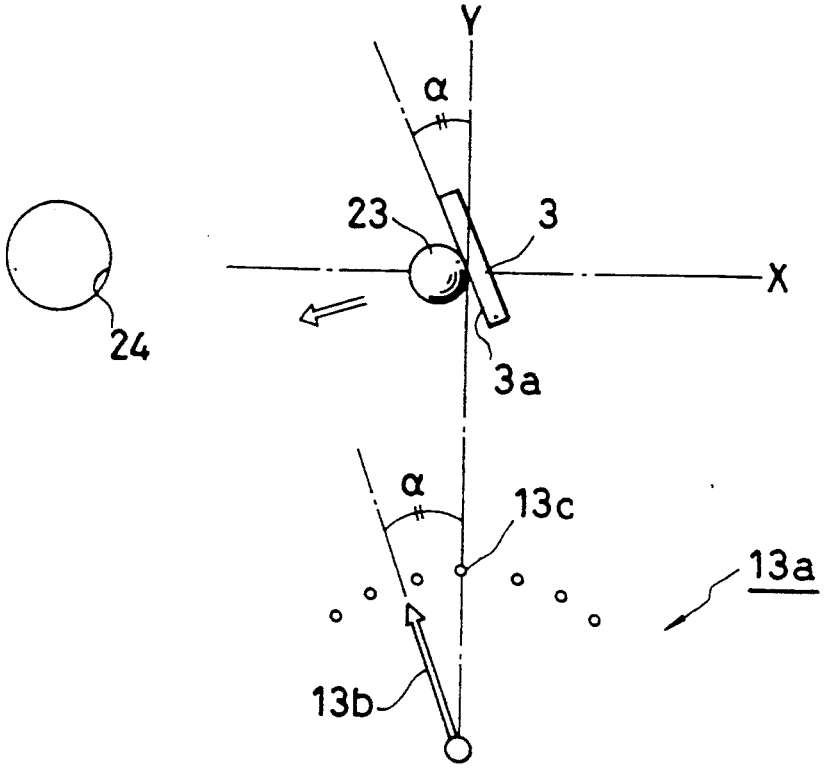
FIG. 5 is a diagrammatic view showing a relationship between rotation of a head of a golf putter and a display device.
Figure 6:
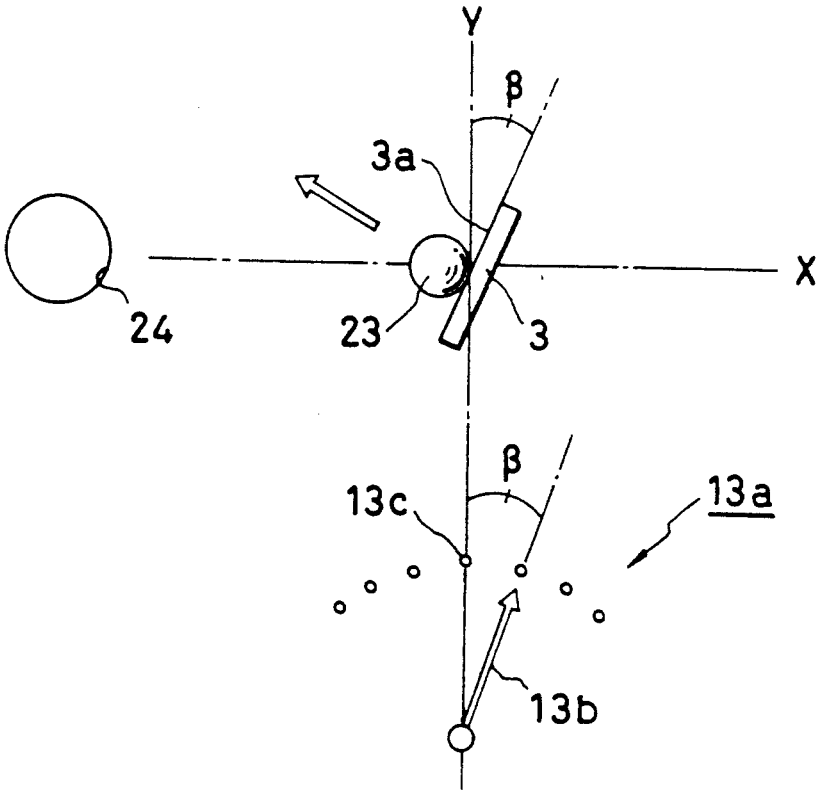
FIG. 6 is a diagrammatic view showing a relationship between reverse rotation of a head of a golf club and a display device.

Supposing that putting practice is to be carried out while aiming at a cup 24 in such a manner as shown in FIG. 5, a practicer normally addresses a ball 23 while positioning the ball hitting face 3*a* of the putter 1 in a manner to be just opposite to a putting line. This results in the axis X of the motor output shaft 19 being aligned with the putting line and the axis Y of rotation of the casing being aligned with or rendered parallel to the face 3*a*.

Subsequently, the putter 1 is backward drawn for backswing and then swung for putting. During such swing of the putter 1, when the shaft 2 is not rotated about a longitudinal axis thereof, the gyro 16 incorporated in the putter 1 is not actuated, resulting in a signal output from the gyro 16 being not changed, so that the pointer 13*b* of the display meter 13*a* is kept stationary at a neutral position 13*c*. This indicates that the practicer hits the the putter 1 with ball 23 while correctly directing the ball hitting face 3*a* toward the target of the swing of the practicer is correct.

On the contrary, turning of a wrist of the practicer or turning of his shoulder and arms during a part of the swing before impacting of the face 3*a* against the ball 23 causes the shaft 2 to be rotated about the longitudinal axis thereof while the position of gripping of the putter is kept stationary. This results in an angular velocity being varied in a moment of rotation of the shaft 2, so that the gyro 16 reacts depending on an acceleration of the variation.

For example, as shown in FIG. 5, the shaft 2 is rotated in a counterclockwise direction or an m direction in FIG. 2 in the moment of hitting the face 3*a* of the putter 3 against the ball 23, the gyro 16 is so rotated that the flywheel 20*a* may be upward moved about the axis Y in FIG. 2. The rotation of the gyro 16 causes the permanent magnet 21 mounted at the distal end of the motor casing to be rotated in the same direction, resulting in a direction of a magnetic flux of the magnet being varied, so that the magneto-electric transducer 22 varied in electric resistance or the like, leading to outputting of a current signal depending on the variation.

Figure 3:
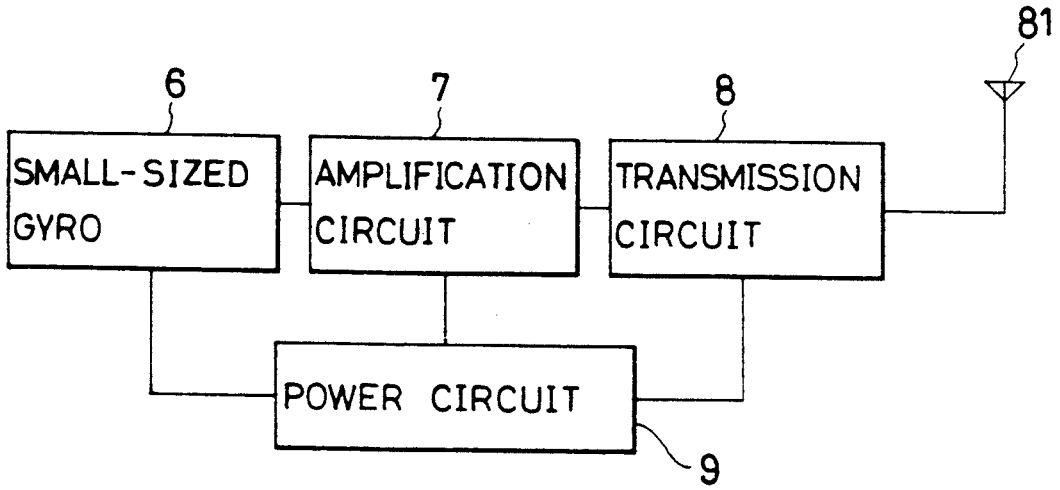
FIG. 3 is a block diagram showing an electric circuit on the side of a cartridge.

The signal thus output from the gyro mechanism 6, as shown in FIG. 3, is amplified through the amplification circuit 1 and then wirelessly outward transmitted from the ball hitting stick 1 through the transmission circuit 8. Efficiency of the transmission may be increased, for example, by arranging a transmission antenna 81 like a fine wire, for example, around an outer peripheral surface of the shaft 2, as shown in FIG. 3.

A radio wave titus transmitted from the transmission circuit 8 is then received by a receiving antenna 110 of the receiver box 10 and input through the receiving circuit 11 and amplification circuit 12 to the display circuit 13. When the ball hitting face 3*a* is rotated by an angle $\alpha$ from a neutral position on the axis Y in FIG. 5, the display meter 13*a* receives a signal indicating a variation in an angular velocity due to the rotation, to thereby display the angle $\alpha$.

To the contrary, when the shaft 2 is rotated in a clockwise direction or an n direction in FIG. 2 the moment the head 3 of the putter 1 is hit against the ball 23, the gyro 16 is turned so as to cause the flywheel 20*b* to be upward moved about the axis Y in FIG. 2, due to its characteristics. An angle $\beta$ thus varied is displayed on the display meter 13.

A neutral angle of the face 3*a* is set on the axis Y in FIG. 5 at which the putter 1 is hit against the ball. In addition, lines parallel to the axis Y which are obtained during the swing each serve as a neutral angle for a basis of detection of the angular variation. Thus, even unintentional movement of the face 3*a* during both backswing and starting swing can be displayed at realtime by movement of the pointer 13*b*.

Swing practice for golf is generally classified into two types. One is swing practice carried out while actually hitting a ball with a club to ascertain a speed of the ball hit and a direction of traveling of the ball and the other is non-hitting swing practice wherein hitting of a ball with a club is not carried out.

The latter practice or non-hitting swing practice using the equipment of the illustrated embodiment can be carried out by locating the receiver box 10 at a suitable place on a floor which departs from an orbit of the swing and permits a practicer to view the pointer 13*b* of the display meter 13*a* while swinging the club. Thus, the practicer can properly diagnose and correct any defect in the swing by himself.

The former practice or hitting practice generally takes place while keeping a ball in view, so that a practicer may not observe movement of the pointer 13*b*. The timer circuit 15 may be arranged in order to avoid problems due to such situation. More particularly, arrangement of the timer circuit 15 as shown FIG. 4 permits an angle of the ball hitting face 13*a* in the moment of hitting of the club against the ball to be temporarily stationarily displayed.

A means for such a temporary stationary display may be obtained by incorporating, into the timer circuit 15, a circuit to which an impact signal generated by the gyro mechanism 6 independently from the above-describes signal indicating a variation in angular velocity due to rotation of the shaft in the moment of striking of the club against the ball is fed in the form of a trigger signal and which stationarily holds a level of an output to the display meter 13*a* while having a peak signal of an angular velocity of rotation of the shaft 2 in the moment of the hitting input thereto.

Selective operation of the stop switch 15*a* and reset switch 15*b* permits the most important movement of the head 3 the moment of impacting of the head 3 against the ball to be stationarily displayed for a desired length of time while permitting an angle of the impacting and its direction to be indicated, so that a practicer may diagnoses the swing without haste after the swing.

In the present invention, the construction extending from the gyro to the display device may be connected to a wire circuit known in the art. Also, data detected may be fed to a data processing device such as a computer, a printer or the like; a recording device; or an output device. Further, the gyro may be incorporated in a part of the stick other than the shaft or mounted on an outside of the stick. In addition, a display by the display meter 13*a* may be replaced with either a digital display or an analog display.

Figure 7A:
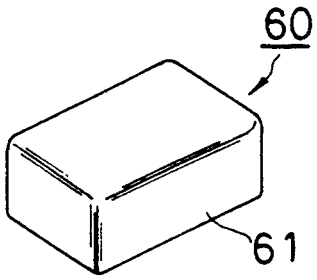
FIG. 7A is a perspective view showing another example of a down-sized gyro.
Figure 7B:
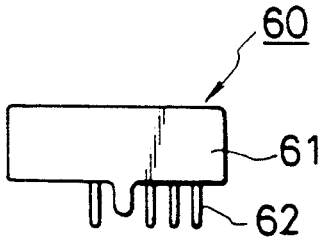
FIG. 7B is a side elevation view of the gyro shown in FIG. 7A.
Figure 8:
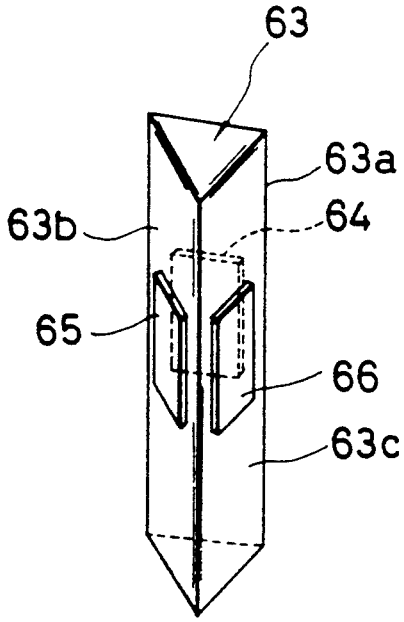
FIG. 8 is a schematic perspective view showing arrangement of an equilateral-triangular vibrator and a piezoelectric ceramic element arranged in the down-sized gyro shown in FIG. 7A.

Also, in the illustrated embodiment, the small-sized gyro 16 is used for the gyro mechanism 6 as shown in FIG. 2, however, the present invention is not limited to such arrangement. For example, a small-sized piezoelectric vibrating gyro indicated at reference numeral 60 in FIGS. 7A and 7B may be substituted for the gyro 16. A piezoelectric vibrating gyro which is commercially available from Kabushiki Kaisba Murata Seisakusho, Japan under a trademark of "Gyrostar" may be used for this purpose. The piezoelectric vibrating gyro 60, as shown in FIGS. 7A to 8, includes a casing 61 and a vibrator 63 formed into an equilateral-triangle pole. The vibrator 63 has three side surfaces 63*a*, 63*b* and 63*c*, on which piezoelectric ceramic elements 64 and 65 for detection and a piezoelectric ceramic element 66 for feedback are mounted, respectively. Reference numeral 62 ( FIG. 7B) designates output terminals. The piezoelectric vibrating gyro 60 thus constructed permits a variation in vibration due to rotation of the shaft to be detected at an angle approximating a right angle, resulting in the detection being carried out with high accuracy, because the two piezoelectric ceramic elements 64 and 65 for detection are arranged in a direction of a synthesized vibration mode. Also, the gyro 60 may be formed into highly reduced dimensions sufficient to be arranged in the cylindrical shaft 1.

As can be seen frown foregoing, the equipment for ball hitting practice according to the present invention can accurately detect and display unintentional rotation of the shaft of the ball hitting stick, because the sensor may be mounted directly on the stick.

Also, the equipment of the present invention permits a variation in rotation of the shaft of the ball hitting stick occurring in swing of the stick from backswing of the stick to impacting of the stick against the ball to be detected and displayed continuously or intermittently, so that a practicer may be satisfactorily provided with data suitable for self-diagnosis and self-correction in both non-hitting swing practice and hitting practice.

Further, the present invention uses a gyro sensor which exhibits highly increased sensitivity with respect to movement of an object, to thereby detect a very fine angular variation in the face of the ball hitting stick.

In addition, the mechanism mounted on the ball hitting stick is microminiaturized and light-weighed and is housed in the shaft of the stick independently from the display mechanism, resulting in the stick being handled in substantially the same feeing as a normal bail hitting stick for a game without deteriorating an appearance of the stick and its swing balance.

Moreover, the equipment of the present invention does not require any specific peripheral device and installation, to thereby be suitable for practice in any desired place. Also, the receiver box may be formed into a pocket size, so that the equipment of the present invention made be portably transported.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A device for ball hitting practice comprising:

a ball hitting stick including a transmission site of the device, a gyro mechanism mounted in the transmission site on said ball hitting stick and structured and arranged to generate a signal;

amplification circuit means for amplifying said signal generated by said gyro mechanism;

a receiver box including a receiving site of the device, said receiver box being separate from said ball hitting stick, a wireless transmission circuit arranged in the transmission site and a wireless receiving circuit arranged in said receiver box, display means for outputting said signal as an angle of unintentional movement of a ball hitting face of said ball hitting stick, said display means being arranged in said receiver box and comprising an angle display meter, power circuit means comprising a first power circuit arranged in the transmission site and a second power circuit arranged in said receiver box, and said amplification circuit means comprising a first amplification circuit arranged in the transmission site and a second amplification circuit arranged in said receiver box, said ball hitting stick including a hollow shaft having a cartridge detachably mounted therein, said gyro mechanism, said first amplification circuit, said wireless transmission circuit and said first power circuit being housed in said cartridge, said wireless receiving circuit, said second amplification circuit, said angle display meter and said second power circuit being housed in said receiver box.

* * * * *